US006969160B2

(12) United States Patent
Lean et al.

(10) Patent No.: US 6,969,160 B2
(45) Date of Patent: Nov. 29, 2005

(54) BALLISTIC AEROSOL MARKING APPARATUS

(75) Inventors: Meng H. Lean, Santa Clara, CA (US); John J. Ricciardelli, Poughkeepsi, NY (US); Michael J. Savino, Tappan, NY (US); Osman T. Polatkan, North Haledon, NJ (US); Fred R. Stolfi, Shrub Oak, NY (US); Eric Lindale, New City, NY (US)

(73) Assignee: Xerox Corporation, Stamford, CT (US)

( * ) Notice: Subject to any disclaimer, the term of this patent is extended or adjusted under 35 U.S.C. 154(b) by 144 days.

(21) Appl. No.: 10/628,844

(22) Filed: Jul. 28, 2003

(65) Prior Publication Data

US 2005/0024446 A1 Feb. 3, 2005

(51) Int. Cl.[7] ..... B41J 2/215; B41J 2/015
(52) U.S. Cl. ..... 347/83; 347/20
(58) Field of Search ..... 347/21, 55, 83, 347/112, 125, 127, 20, 77

(56) References Cited

U.S. PATENT DOCUMENTS

| | | | | |
|---|---|---|---|---|
| 2,573,143 | A | 10/1951 | Jacob | 178/5.2 |
| 2,577,894 | A | 12/1951 | Jacob | 346/75 |
| 3,152,858 | A | 10/1964 | Wadey | 346/75 |
| 3,572,591 | A | 3/1971 | Brown | 239/337 |
| 3,977,323 | A | 8/1976 | Pressman et al. | 101/426 |
| 3,997,113 | A | 12/1976 | Pennebaker, Jr. | 239/15 |
| 4,019,188 | A | 4/1977 | Hochberg et al. | 347/75 |
| 4,106,032 | A | 8/1978 | Miura et al. | 346/140 R |
| 4,113,598 | A | 9/1978 | Jozwiak, Jr. et al. | 204/181 R |
| 4,146,900 | A | 3/1979 | Arnold | 346/75 |
| 4,171,777 | A | 10/1979 | Behr | 239/422 |
| 4,189,937 | A | 2/1980 | Nelson | 73/28 |
| 4,196,437 | A | 4/1980 | Hertz | 346/1.1 |
| 4,223,324 | A | 9/1980 | Yamamori et al. | 346/140 R |
| 4,271,100 | A | 6/1981 | Trassy | 261/78 A |
| 4,284,418 | A | 8/1981 | Andres | 55/16 |
| 4,368,850 | A | 1/1983 | Szekely | 239/333 |
| 4,403,228 | A | 9/1983 | Miura et al. | 346/75 |
| 4,403,234 | A | 9/1983 | Miura et al. | 346/140 R |

(Continued)

FOREIGN PATENT DOCUMENTS

EP 0 655 337 A2 11/1994

(Continued)

OTHER PUBLICATIONS

Anger, F., Jr. et al. "Low Surface Energy FluoroEpoxy Coating for Drop-on-Demand Nozzles," IBM Technical Disclosure Bulletin, vol. 26, No. 1, P. 431, Jun. 1983.

(Continued)

*Primary Examiner*—Manish S. Shah
*Assistant Examiner*—Geoffrey S. Mruk
(74) *Attorney, Agent, or Firm*—Perman & Green, LLP

(57) ABSTRACT

A toner gating apparatus for supplying toner through an aperture to a gas channel having a propellant stream. The toner gating apparatus has a traveling wave grid having electrodes. A first gating electrode is located proximate a first side of the aperture. A second gating electrode is located proximate a second side of the aperture. A third gating electrode is located in the gas channel. A first voltage source having a first phase is connected to both the first gating electrode and a first electrode of the travelling wave grid. A second voltage source having a second phase is connected to both the second gating electrode and a second electrode of the travelling wave grid. A third voltage source having a third phase is connected to both the third gating electrode and a third electrode of the travelling wave grid.

24 Claims, 4 Drawing Sheets

U.S. PATENT DOCUMENTS 4,480,259 A 10/1984 Kruger et al. ..... 346/140 R
4,490,728 A 12/1984 Vaught et al. ..... 346/1.1
4,500,895 A 2/1985 Buck et al. ..... 346/140 R
4,514,742 A 4/1985 Suga et al. ..... 346/140 R
4,515,105 A 5/1985 Danta et al. ..... 118/629
4,544,617 A 10/1985 Mort et al. ..... 430/58
4,606,501 A 8/1986 Bate et al. ..... 239/346
4,607,267 A 8/1986 Yamamuro ..... 346/140 R
4,613,875 A 9/1986 Le et al. ..... 346/140 R
4,614,953 A 9/1986 Lapeyre ..... 346/140 R
4,634,647 A 1/1987 Jansen et al. ..... 430/84
4,647,179 A 3/1987 Schmidlin ..... 355/3 DD
4,663,258 A 5/1987 Pai et al. ..... 430/57
4,666,806 A 5/1987 Pai et al. ..... 430/57
4,683,481 A 7/1987 Johnson ..... 346/140 R
4,720,444 A 1/1988 Chen ..... 430/58
4,728,969 A 3/1988 Le et al. ..... 346/140 R
4,741,930 A 5/1988 Howard et al. ..... 427/265
4,760,005 A 7/1988 Pai ..... 430/65
4,770,963 A 9/1988 Pai et al. ..... 430/64
4,791,046 A 12/1988 Ogura ..... 430/296
4,839,232 A 6/1989 Morita et al. ..... 428/473.5
4,839,666 A 6/1989 Jayne ..... 346/75
4,870,430 A 9/1989 Daggett et al. ..... 346/140 R
4,882,245 A 11/1989 Gelorme et al. ..... 430/14
4,896,174 A 1/1990 Stearns ..... 346/459
4,929,968 A 5/1990 Ishikawa ..... 346/140 R
4,961,966 A 10/1990 Stevens et al. ..... 427/299
4,973,379 A 11/1990 Brock et al. ..... 156/640
4,982,200 A 1/1991 Ramsay ..... 346/75
4,982,404 A 1/1991 Hartman ..... 347/173
5,030,536 A 7/1991 Pai et al. ..... 430/127
5,041,849 A 8/1991 Quate et al. ..... 346/140 R
5,045,870 A 9/1991 Lamey et al. ..... 346/140 R
5,063,655 A 11/1991 Lamey et al. ..... 29/611
5,066,512 A 11/1991 Goldowsky et al. ..... 427/14.1
5,113,198 A 5/1992 Nishikawa et al. ..... 346/1.1
5,190,817 A 3/1993 Terrell et al. ..... 428/343
5,202,704 A 4/1993 Isao ..... 346/140 R
5,208,630 A 5/1993 Goodbrand et al. ..... 355/201
5,209,998 A 5/1993 Kavassalis et al. ..... 430/106
5,240,153 A 8/1993 Tubaki et al. ..... 222/385
5,240,842 A 8/1993 Mets ..... 435/172.3
5,294,946 A 3/1994 Gandy et al. ..... 346/140 R
5,300,339 A 4/1994 Hays et al. ..... 428/36.9
5,350,616 A 9/1994 Pan et al. ..... 428/131
5,385,803 A 1/1995 Duff et al. ..... 430/138
5,397,664 A 3/1995 Noelscher et al. ..... 430/5
5,403,617 A 4/1995 Haaland ..... 427/180
5,425,802 A 6/1995 Burton et al. ..... 95/32
5,426,458 A 6/1995 Wenzel et al. ..... 347/45
5,428,381 A 6/1995 Hadimioglu et al. ..... 347/46
5,482,587 A 1/1996 McAleavey ..... 156/243
5,491,047 A 2/1996 Kim et al. ..... 430/329
5,510,817 A 4/1996 Sohn ..... 347/21
5,512,712 A 4/1996 Iwata et al. ..... 174/258
5,520,715 A 5/1996 Oeftering ..... 75/335
5,522,555 A 6/1996 Poole ..... 241/33
5,535,494 A 7/1996 Plesinger et al. ..... 29/25.35
5,541,625 A 7/1996 Holstun et al. ..... 347/5
5,554,480 A 9/1996 Patel et al. ..... 430/137
5,600,351 A 2/1997 Holstun et al. ..... 347/40
5,604,519 A 2/1997 Keefe et al. ..... 347/13
5,635,969 A 6/1997 Allen ..... 347/96
5,640,187 A 6/1997 Kashiwazaki et al. ..... 347/101
5,646,656 A 7/1997 Leonhardt et al. ..... 347/43
5,654,744 A 8/1997 Nicoloff, Jr. et al. ..... 347/43
5,678,133 A 10/1997 Siegel ..... 399/67
5,682,190 A 10/1997 Hirosawa et al. ..... 347/94
5,712,669 A 1/1998 Swanson et al. ..... 347/49
5,717,986 A 2/1998 Vo et al. ..... 399/291
5,731,048 A 3/1998 Ashe et al. ..... 427/585
5,756,190 A 5/1998 Hosomi et al. ..... 428/209
5,761,783 A 6/1998 Osawa et al. ..... 29/25.35
5,777,636 A 7/1998 Naganuma et al. ..... 347/10
5,780,187 A 7/1998 Pierrat ..... 430/5
5,787,558 A 8/1998 Murphy ..... 29/25.35
5,818,477 A 10/1998 Fullmer et al. ..... 347/43
5,853,906 A 12/1998 Hsieh ..... 428/690
5,882,830 A 3/1999 Visser et al. ..... 430/59
5,893,015 A 4/1999 Mojarradi et al. ..... 399/291
5,900,898 A 5/1999 Shimizu et al. ..... 347/93
5,958,122 A 9/1999 Fukuda et al. ..... 106/31.57
5,967,044 A 10/1999 Marschke ..... 101/363
5,968,674 A 10/1999 Hsieh et al. ..... 428/690
5,969,733 A 10/1999 Sheinman ..... 347/75
5,981,043 A 11/1999 Murakami et al. ..... 428/209
5,990,197 A 11/1999 Escano et al. ..... 523/160
5,992,978 A 11/1999 Fujii et al. ..... 347/54
6,019,466 A 2/2000 Hermanson ..... 347/104
6,036,295 A 3/2000 Ando et al. ..... 347/7
6,081,281 A 6/2000 Cleary et al. ..... 347/21
6,116,178 A * 9/2000 McCabe ..... 114/102.13
6,116,718 A 9/2000 Peeters et al. ..... 347/21
6,290,342 B1 * 9/2001 Vo et al. ..... 347/85
6,328,436 B1 * 12/2001 Floyd et al. ..... 347/85
6,416,158 B1 * 7/2002 Floyd et al. ..... 347/21

FOREIGN PATENT DOCUMENTS

EP 0 726 158 A1 8/1996
JP 53-35539 4/1978
JP 55-19556 2/1980
JP 55-28819 2/1980
JP 56-146773 11/1981
JP 57192027 A 11/1982
JP 58-224760 12/1983
JP 60-229764 11/1985
JP 62-35847 2/1987
JP 02-293151 12/1990
JP 4-158044 6/1992
JP 4-182138 6/1992
JP 5-4348 1/1993
JP 5-193140 8/1993
JP 5-269995 10/1993
WO WO93/11866 6/1993
WO WO94/18011 8/1994
WO WO97/01449 1/1997
WO WO 97/27058 7/1997

OTHER PUBLICATIONS

Author Unknown, "Array Printers Demonstrates First Color Printer Engine", The Hard Copy Observer Published by Lyra Research, Inc., vol. V111, No. 4, p. 36, Apr. 1998.

Fuchs, N.A. "The Mechanics of Aerosols", Dover Publications, Inc. p. 79, 367-377, 1989 (Originally published in 1964 by Pergamon Press Ltd.).

Le, Hue et al. "Air-Assisted Ink Jet with Mesa-Shaped Ink-Drop-Forming Orifice", Presented at the Fairmont Hotel in Chicago and San Jose, Fall 1987, p. 223-227.

U.S. Appl. No. 09/041,353, entitled "Coated Photographic Papers", McAneney et al. filed Mar. 12, 1998.

U.S. Appl. No. 09/407,908, entitled "Ballistic Aerosol Marking Apparatus with Stacked Electrode Structure", filed Sep. 29, 1999.

U.S. Appl. No. 09/410,371, entitled "Ballistic Aerosol Marking Apparatus with Non-wetting Coating", filed Sep. 30, 1999.

U.S. Appl. No. 09/163,839, entitled "Ballistic Aeorsol Marking Apparatus for Marking a Substrate", filed Sep. 30, 1998.

U.S. Appl. No. 09/164,124, entitled "Method of Marking a Substrate Employing a ballistic Aerosol Marking Apparatus", filed Sep. 30, 1998.
U.S. Appl. No. 09/164,250, entitled "Ballistic Aerosol Marking Apparatus for Treating a Substrate", filed Sep. 30, 1998.
U.S. Appl. No. 09/163,808 entitled "Method of Treating a Substrate Employing a Ballistic Aerosol Marking Apparatus", filed Sep. 30, 1998.
U.S. Appl. No. 09/163,765, entitled Cartridge for Use in a Ballistic Aerosol Marking Apparatus, filed Sep. 30, 1998.
U.S. Appl. No. 09/163,839, entitled "Marking Material Transport", filed Sep. 30, 1998.
U.S. Appl. No. 09/163,954, entitled "Ballistic Aerosol Marking Apparatus for Marking with a Liquid Material", filed Sep. 30, 1998.
U.S. Appl. No. 09/163,924, entitled Method for Marking with a Liquid Material Using a Ballistic Aerosol Marking Apparatus, filed Sep. 30, 1998.
U.S. Appl. No. 09/163,799, entitled "Method of Making a Print Head for Use in a Ballistic Aerosol Marking Apparatus" filed Sep. 30, 1998.
U.S. Appl. No. 09/163,664, entitled "Organic Overcoat for Electrode Grid", filed Sep. 30, 1998.
U.S. Appl. No. 09/164,104, entitled "Kinetic Fusing of a Marking Material", filed Sep. 30, 1998.
U.S. Appl. No. 09/163,825, entitled "Multi-Layer Organic Overcoat for Electrode Grid", filed Sep. 30, 1998.

* cited by examiner

BALLISTIC AEROSOL MARKING APPARATUS

CROSS-REFERENCE TO RELATED APPLICATIONS

The present invention is related to U.S. patent application Ser. Nos. 09/163,893, 09/164,124, 09/163,808, 09/163,765, 09/163,839 now U.S. Pat. No. 6,290,342, Ser. Nos. 09/163,954, 09/163,924, 09/163,904 now U.S. Pat. No. 6,116,718, Ser. Nos. 09/163,799, 09/163,664 now U.S. Pat. No. 6,265,050, Ser. Nos. 09/163,518, 09/164,104, 09/163,825, issued U.S. Pat. No. 5,717,986, and U.S. Pat. Nos. 5,422,698, 5,893,015, 5,968,674, and 5,853,906, each of the above being incorporated herein by reference.

BACKGROUND OF THE INVENTION

1. Field of the Invention

The present invention relates to a ballistic aerosol marking apparatus and, more particularly to a gating method and apparatus for ballistic aerosol marking.

2. Background of the Invention

Ballistic Aerosol Marking (BAM) systems are known to eject particulate marking materials for marking a substrate. For example, U.S. Pat. No. 6,340,216 and U.S. Pat. No. 6,416,157, which are hereby incorporated by reference in their entirety, disclose a single-pass, full-color printer which deposits marking materials such as ink or toner. High speed printing either directly onto paper or a substrate or indirectly through an intermediate medium can be achieved using Ballistic Aerosol Marking (BAM) systems. An array or multiplicity of channels are provided in a print head through which a propellant stream is directed. Marking material or multiple marking materials may be introduced into the channel and the propellant stream to be mixed and deposited on the substrate. When using particulate or solid based marking material, the material must be metered through an aperture into the channel from a reservoir. An example of moving and metering the marking material is also disclosed in U.S. Pat. No. 6,290,342 which is hereby incorporated by reference in its entirety. A plurality of electrodes are provided with an electrostatic travelling wave to sequentially attract particles to transport them to a desired location. At higher resolutions, only very low agglomeration, or powdery toner can be metered through the smaller apertures. When using such smaller apertures and low agglomeration toner, problems encountered include clogging and surface adhesion of the marking material to the walls of the channel, aperture or metering device. Additional problems are encountered in precisely metering the material to be deposited in order to effectively mix colors or achieve proper gray scale on deposition of the marking material. Accordingly, there is a desire to provide a Ballistic Aerosol Marking (BAM) system capable of precisely metering marking material without clogging or surface adhesion issues.

SUMMARY OF THE INVENTION

In accordance with one embodiment of the present invention, a ballistic aerosol marking print head for depositing marking material is provided having a gas channel coupled to a propellant source. A reservoir is provided in communication with the gas channel through an aperture. A first gating electrode is located proximate a first side of the aperture. A second gating electrode is located proximate a second side of the aperture. A third gating electrode is located in the gas channel. A first voltage source having a first phase is connected to the first gating electrode. A second voltage source having a second phase in phase separation from the first phase is connected to the second gating electrode. A third voltage source having a third phase in phase separation from the first phase and the second phase is connected to the third gating electrode. The first phase, second phase and third phase are sequenced so that marking material is metered from the reservoir into a propellant stream in the gas channel.

In accordance with another embodiment of the present invention, a toner gating apparatus is provided for supplying toner through an aperture to a gas channel having a propellant stream. The toner gating apparatus has a traveling wave grid having electrodes. A first gating electrode is located proximate a first side of the aperture. A second gating electrode is located proximate a second side of the aperture. The gating may be implemented in two modes: continuous and on-demand. A third gating electrode is located in the gas channel. A first voltage source having a first phase is connected to both the first gating electrode and a first electrode of the travelling wave grid. A second voltage source having a second phase is connected to both the second gating electrode and a second electrode of the travelling wave grid. In continuous mode, a third voltage source having a third phase is connected to both the third gating electrode and a third electrode of the travelling wave grid. In on-demand mode, the voltage source for the third gating electrode is connected to the data line for print-on-demand capability.

In accordance with a method of the present invention, a method of metering toner through an aperture into a propellant stream has a first step of providing a traveling wave grid having electrodes. Steps of locating a first gating electrode proximate a first side of the aperture, locating a second gating electrode proximate a second side of the aperture and locating a third gating electrode where the propellant stream is located between the second and third gating electrodes are then provided. Steps of connecting a first voltage source having a first phase to both the first gating electrode and a first electrode of the travelling wave grid, connecting a second voltage source having a second phase lagging the first phase to both the second gating electrode and a second electrode of the travelling wave grid and connecting a third voltage source having a third phase lagging the second phase to both the third gating electrode and a third electrode of the travelling wave grid are then provided.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENT

Figure 1:
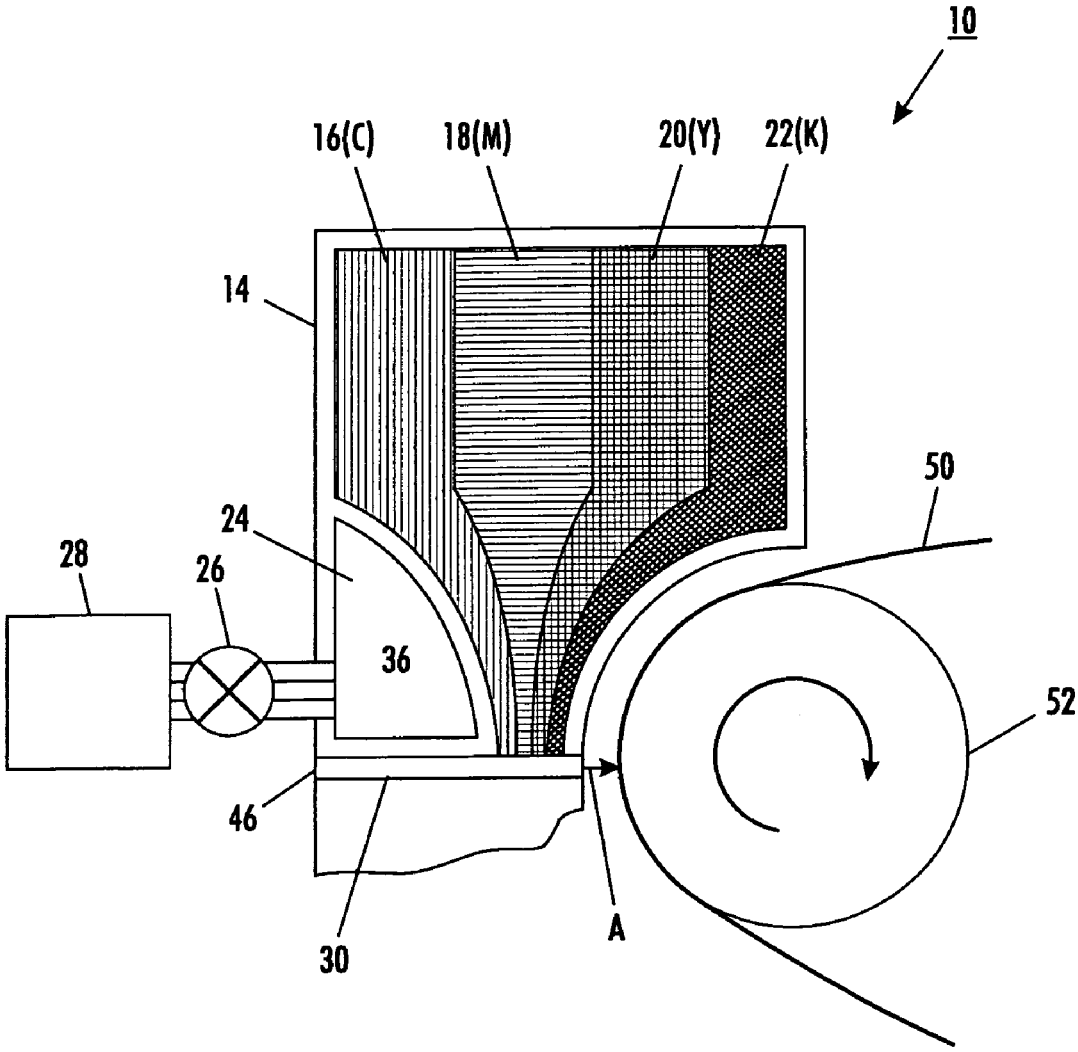
FIG. 1 is a side schematic section view of a Ballistic Aerosol Marking (BAM) system incorporating features of the present invention.

Referring to FIG. 1, there is shown a side schematic section view of a Ballistic Aerosol Marking (BAM) system incorporating features of the present invention. Although the present invention will be described with reference to the embodiments shown in the drawings, it should be understood that the present invention can be embodied in many alternate forms of embodiments. In addition, any suitable size, shape or type of elements or materials could be used.

Ballistic aerosol marking device 10 may form a part of a printer, for example of the type commonly attached to a computer network, personal computer or the like, part of a facsimile machine, part of a document duplicator, part of a labeling apparatus, or part of any other of a wide variety of marking devices. The materials to be deposited may be 4 colored toners, for example cyan (C), magenta (M), yellow (Y), and black (K), which may be deposited either mixed or unmixed, successively, or otherwise. In alternate embodiments, more or less toners, colors or marking materials may be provided. BAM Device 10 has a body 14 within which is formed a plurality of cavities 16, 18, 20, 22 for receiving materials to be deposited. Also formed in body 14 may be a propellant cavity 24 for propellant 36. A fitting 26 may be provided for connecting propellant cavity 24 to a propellant source 28 such as a compressor, a propellant reservoir, or the like. Body 14 may be integrally formed as part of or connected to a print head 30. Print head 30 has one or more ejectors having channels 46 (only one channel is shown in FIG. 1 for example purposes) through which the propellant 36 is fed. Marking material is caused to flow out from cavities 16, 18, 20, 22 and is transported and metered into the ejector into a stream of propellant flowing through channel 46. The marking material and propellant are directed in the direction of arrow A toward a substrate 50, for example paper, supported by a platen 52.

Figure 2:
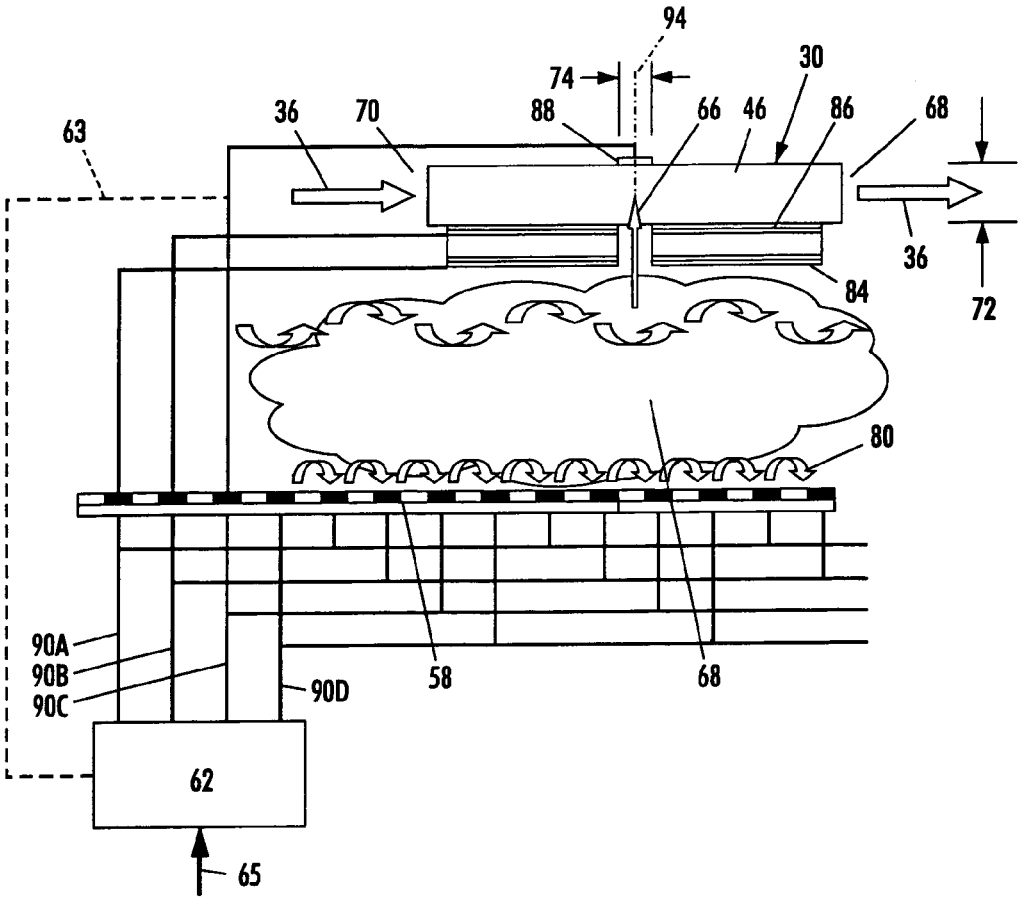
FIG. 2 is a side schematic section view of a gating device and electrode grid of the Ballistic Aerosol Marking (BAM) system in FIG. 1.

Referring now to FIG. 2, there is shown a side schematic section view of Print Head 30 of Ballistic Aerosol Marking (BAM) direct marking process having an electrode grid 58. Print head 30 has one or more channels 46 to which a propellant 36 is fed. FIG. 2 shows an exemplary channel 46 and a gating device metering marking material into the channel. The marking material 68 may be transported from a marking material reservoir, such as cavities 16, 18, 20, 22 (not shown, see FIG. 1) by an electrode grid 58 under the control of controller 62 via a four phase circuit to drive the travelling wave 80. In alternate embodiments, transporting methods other than electrode grid 58 may be employed or more or less phases may be provided. The marking material 68 is metered and introduced into channel 46 through aperture 66. The marking material 68, which may be fluidized toner is metered through a two phase or three phase gating device by electrostatic forces which will be described in more detail below. For 300 dpi resolution, aperture 66 may have a diameter 74 of approximately 50 um to conform to a channel width 72 of approximately 84 um. In alternate embodiments, any suitable aperture size and channel width may be used. For this scale, low agglomeration or "powdery" 6 um toner can be used. In the embodiment shown, and depending upon the effectiveness of the gating system, gated toner can make the effective aperture size approximately 25–30 um down from 50 um due to surface adhesion. This is explained in that only 8 toner particles can fit diagonally across the aperture 66 and two layers may be attached or otherwise adhered to the aperture walls by van der Waals adhesion or through toner-toner co-hesion. The aperture 66 may be fabricated from Au coated 2 mil Kapton film with a laser drilled 50 um hole. In alternate embodiments, other suitable materials may be used. The centerline of aperture 66 is shown approximately 90 degrees from the channel flow path. In alternate embodiments, other angles may be employed and other sizes or shapes may be used. In alternate embodiments, more apertures, and transporting devices may interface with channel 46, such as in the instance where multiple colors or marking materials are introduced into channel 46. Channel 46 may be formed as a Laval type expansion nozzle incorporating a venturi structure or otherwise having an exit end 68 and a propellant supply end 70.

For high speed printing, it is desirable that marking material 68 or toner be reliably and continuously supplied to gating aperture 66. Factors that influence successful gating include lightly agglomerated or loosely packed toner, continuously replenished supply of toner, and for any gating rate, the toner density at the aperture inlet be controllable. In the embodiment shown, a 3 phase electrode configuration is provided having a first gating electrode 84 on a first (reservoir, grid or supply) side of aperture 66. A second gating electrode 86 is provided on a second or channel side of aperture 66. A third gating electrode 88 is provided in gas channel 46 and opposing aperture 66. The marking material or toner 68 is transported from a marking material reservoir, such as cavities 16, 18, 20, 22 (not shown, see FIG. 1) by electrode grid 58 under the control of controller 62 via a four phase circuit to drive the travelling wave 80. Electrode grid 58 has electrodes 90A, 90B, 90C, 90D which may form a repeating pattern as shown. In alternate embodiments more or less electrodes or more or less repeating patterns may be provided. Phased voltages, or voltage sources which may be in the range of 25–500 volts with frequencies of hundreds of hertz through thousands of hertz or otherwise are applied to electrodes 90A, 90B, 90C, 90D that form a travelling wave of either a d.c. phase or a.c. phase. In alternate embodiments, different voltage levels and frequencies may be used. In the embodiment shown, continuous gating is established by selectively connecting gating electrode 84 to electrode 90A, and gating electrode 86 to electrode 90B and gating electrode 88 to electrode 90C. The connection configuration between the gating electrodes and electrodes of the grid shown in FIG. 2 is representative, and any suitable configuration may be used. As seen in FIG. 2, the controller 62 may be connected by any suitable communication means 63 to gating electrode 88 in order to allow operation of the electrode in an on-demand gating mode. In on-demand gating, the third electrode is connected to the data line. In this embodiment, the data line 65 (corresponding to the data embodying the image to be printed with a given channel 46 of print head 30) is connected to controller 62. The controller then generates a suitable signal according to the data line, that is communicated via means 63 to switch the electrode 88 on/off. In alternate embodiments, the controller may be connected for on demand operation to any of the electrodes as desired. The controller 62 selects whether the electrode is operated in one of the continuous or on-demand modes as desired. The three phase, three electrode gating electrode configuration maximizes toner gating effectiveness where the third gating electrode 88 is located on the gas channel floor opposing the aperture 66. Where a two phase configuration is provided such as where gating electrodes on the reservoir side and channel side are provided without a third gating electrode, a stagnation point may occur during pulse switching intervals where some forward and backward sloshing of toner may occur. With a three phase configuration as shown in FIG. 2, such as having gating electrodes 84, 86 and a third phase connected to gating electrode 88, the stagnation zone is minimized or all together prevented from forming. Additionally, because the space between gating electrode 86 and gating electrode 88 is the gas channel 46, there is no surface for toner adhesion and, as a result, less tendency for the effective aperture to decrease. Gating electrode 88 also presents a projection field during the active interval that ensures that toner will move into channel 46 to be entrained for printing.

Figure 3:
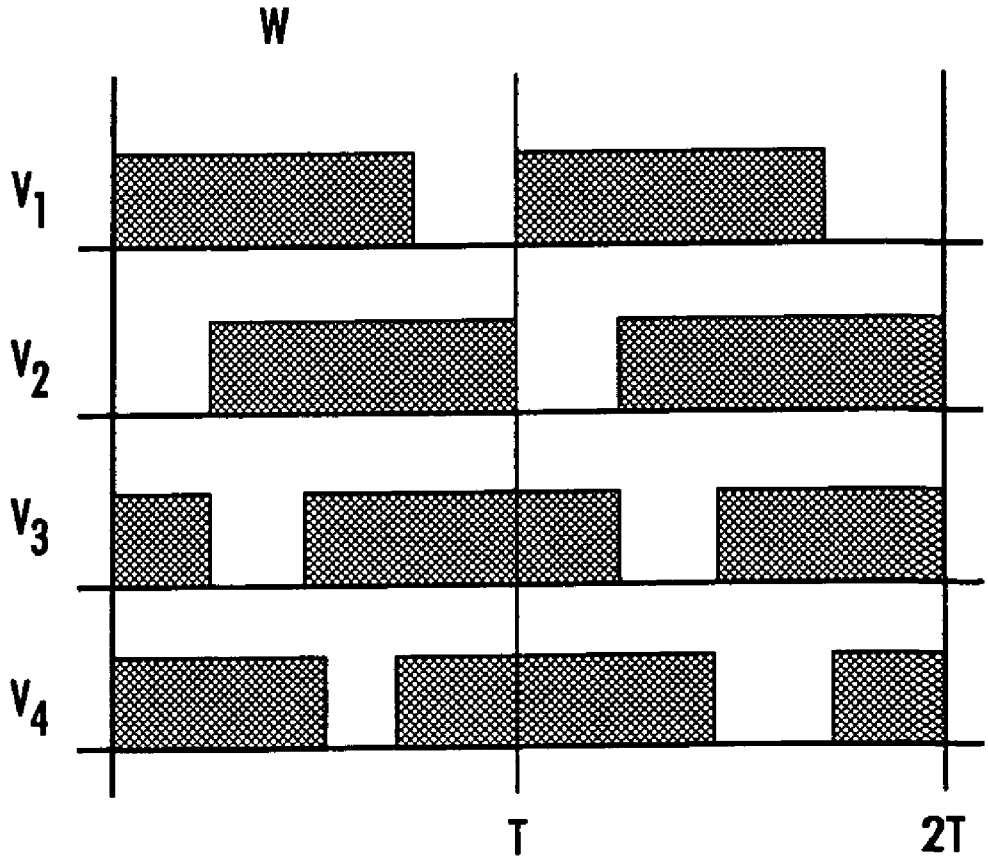
FIG. 3 is a sample waveform such as may be used with the electrode grid in FIG. 2.

Referring now to FIG. 3 there is shown a sample waveform produced by the four phase circuit with two cycles in the voltage patterns in the travelling wave of FIG. 2. Line V1 represents the voltage applied to electrodes 90A and 84, Line V2 represents the voltage applied to electrodes 90B and 86, V3 represents the voltage applied to electrodes 90C and 88 and V4 represents the voltage applied to electrode 90D. In the embodiment shown, these voltages are phased approximately by 90 degrees. In alternate embodiments, such as where electrode 90D with V4 is not provided; the voltages may be phased by approximately 120 degrees. In alternate embodiments, such as where electrodes 88, 90C and 90D with V3 and V4 are not provided, the voltages may be phased by approximately 180 degrees. In alternate embodiments more or less electrode configurations, phases or duties may be provided. In the embodiment shown, the voltage sources are phased direct current sources, however in alternate embodiments the voltage sources may be different, for example phased alternating current sources.

Figure 4A:
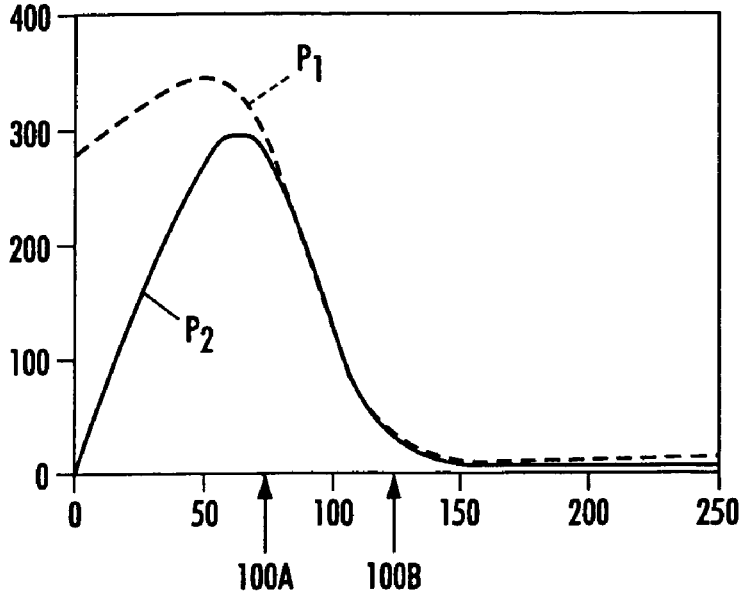
FIG. 4A is a potential comparison graph of the gating device.
Figure 4B:
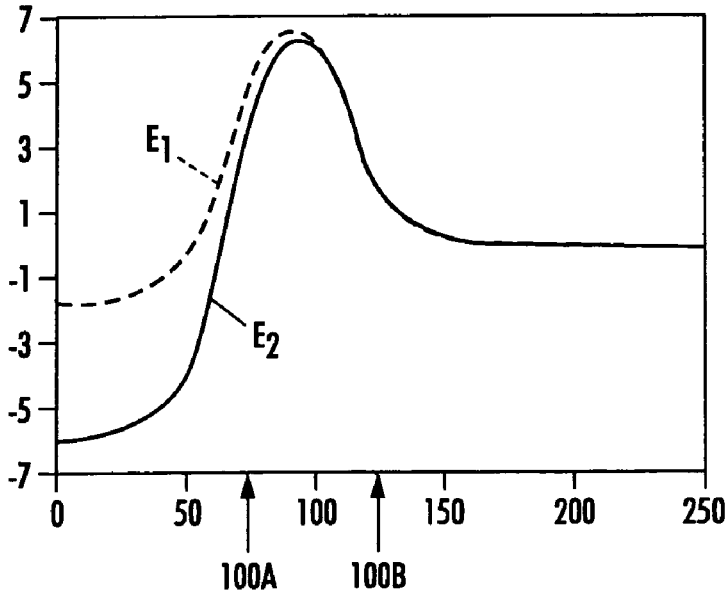
FIG. 4B is a Axial E-Field comparison graph of the gating device.

Referring now to FIG. 4A there is shown a potential comparison graph for corresponding two and three phase gating structures. The graph represents the potential distribution along the aperture axis 94. The horizontal axis represents distance from the gas channel floor in um. The vertical axis represents the potential along the aperture axis 94 in Volts. Data shown is for a channel height of approximately 65 um (similar to channel 46 in FIG. 2), aperture thickness of 50 um (of a representative aperture similar to aperture 66) and electrode voltage of 400 volts. The dashed line P1 represents a two phase configuration whereas the solid line P2 represents a three phase configuration. The roof of the channel is represented by 100A and the top of the gating aperture is represented by 100B. Referring now to FIG. 4B there is shown an axial E-field comparison graph comparing the axial E-field for two and three phase gating structures. The graph represents the axial E-field along the aperture axis similar to axis 94 (see FIG. 2). The horizontal axis represents distance from the gas channel floor in um. The vertical axis represents the axial E-field along the aperture axis similar to axis 94 in V/um. Data shown is for a channel height of approximately 65 um, aperture thickness of 50 um and electrode voltage of 400 volts. The dashed line E1 represents a two phase configuration whereas the solid line E2 represents a three phase configuration. The roof of the channel is represented by 100A and the top of the gating aperture is represented by 100B. The three phase case shows approximately four times the field strength at the channel floor resulting in much higher coulomb forces pulling toner directly from the aperture into the gas channel.

It should be understood that the foregoing description is only illustrative of the invention. Various alternatives and modifications can be devised by those skilled in the art without departing from the invention. Such alternatives or modifications could be combining different expansion funnels with different columns or no columns as an example. Such alternatives or modifications could be mounting the expansion funnel further within the expansion chamber or product container as a further example. Accordingly, the present invention is intended to embrace all such alternatives, modifications and variances which fall within the scope of the appended claims.

What is claimed is:

1. A ballistic aerosol marking print head for depositing marking material, the print head comprising:

a gas channel coupled to a propellant source;

a reservoir in communication with the gas channel through an aperture;

a first gating electrode located proximate a first side of the aperture;

a second gating electrode located proximate a second side of the aperture;

a third gating electrode located in the gas channel;

a first voltage source having a first phase connected to the first gating electrode;

a second voltage source having a second phase in phase separation from the first phase, the second voltage source connected to the second gating electrode; and a third voltage source having a third phase in phase separation from the second phase, the third voltage source connected to the third gating electrode;

wherein the first phase, second phase and third phase are sequenced to energize the first gating electrode, the second gating electrode and the third gating electrode in consecutive series, so that marking material is metered from the reservoir into a propellant stream in the gas channel.

2. The ballistic aerosol marking print head of claim 1 wherein at least one of the first gating electrode, the second gating electrode or third gating electrode is connected to a corresponding one of the first voltage source, second voltage source or third voltage source so that the at least one of the first gating electrode, the second gating electrode or third gating electrode is selectably operable in one of a continuous mode and an on-demand mode.

3. The ballistic aerosol marking print head of claim 1 wherein the third gating electrode is controlled by a data line for selectively operating the third gating electrode.

4. The ballistic aerosol marking print head of claim 1 wherein the aperture has a diameter less than 65 micrometers.

5. The ballistic aerosol marking print head of claim 1 wherein the gas channel comprises a nozzle and wherein the third gating electrode is opposing the aperture.

6. The ballistic aerosol marking print head of claim 1 wherein the third phase lags the second phase by approximately 90 degrees and the second phase lags the first phase by approximately 90 degrees.

7. The ballistic aerosol marking print head of claim 1 wherein the first, second and third voltage sources are alternating current sources or phased direct current sources having the same frequency.

8. The ballistic aerosol marking print head of claim 1 further comprising:

a traveling wave grid having first, second and third electrodes located within the reservoir;

the first electrode connected to the first voltage source;

the second electrode connected to the second voltage source; and the third electrode connected to the third voltage source.

9. The ballistic aerosol marking print head of claim 8 wherein the traveling wave grid further comprises a fourth electrode connected to a fourth voltage source having a fourth phase, the fourth phase lagging the third phase by approximately 90 degrees.

10. The ballistic aerosol marking print head of claim 1 wherein the distance from the second gating electrode to the third gating electrode is less than 100 micrometers.

11. The ballistic aerosol marking print head of claim 5 wherein the aperture has a centerline substantially perpendicular to the direction of flow of the propellant stream.

12. The ballistic aerosol marking print head of claim 5 wherein the marking material comprises low agglomeration toner having a particle size of 6 micrometers.

13. A toner gating apparatus for supplying toner through an aperture to a gas channel having a propellant stream, the toner gating apparatus comprising:

a traveling wave grid having electrodes;

a first gating electrode located proximate a first side of the aperture;

a second gating electrode located proximate a second side of the aperture;

a third gating electrode located in the gas channel;

a first voltage source having a first phase and being connected to both the first gating electrode and a first electrode of the travelling wave grid;

a second voltage source having a second phase and being connected to both the second gating electrode and a second electrode of the travelling wave grid; and a third voltage source having a third phase and being connected to both the third gating electrode and a third electrode of the travelling wave grid.

14. The toner gating apparatus of claim 13 wherein at least one of the first gating electrode, the second gating electrode or third gating electrode is connected to a corresponding one of the first voltage source, second voltage source or third voltage source so that the at least one of the first gating electrode, the second gating electrode or third gating electrode is selectably operable in one of a continuous mode or an on-demand mode.

15. The toner gating apparatus of claim 13 wherein the third gating electrode is connected to a data line for selectively operating the third gating electrode.

16. The toner gating apparatus of claim 13 further comprising a fourth electrode of the travelling wave grid connected to a fourth voltage source having a fourth phase, the fourth phase lagging the third phase by approximately 90 degrees.

17. The toner gating apparatus of claim 13 wherein the third phase lags the second phase by approximately 90 degrees and the second phase lags the first phase by approximately 90 degrees.

18. The toner gating apparatus of claim 16 wherein the third phase lags the second phase by approximately 90 degrees and the second phase lags the first phase by approximately 90 degrees.

19. The toner gating apparatus of claim 13 wherein the first, second and third voltage sources are alternating current sources or phased direct current sources having the same frequency.

20. The toner gating apparatus of claim 13 wherein the toner comprises low agglomeration toner having a particle size of 6 micrometers.

21. The toner gating apparatus of claim 13 wherein the distance from the second gating electrode to the first gating electrode is less than 100 micrometers and wherein the distance from the second gating electrode to the third gating electrode is less than 100 micrometers.

22. An image transfer apparatus having a toner gating apparatus according to claim 13.

23. A method of metering toner through an aperture into a propellant stream, the method comprising the steps of:

providing a traveling wave grid having electrodes;

locating a first gating electrode proximate a first side of the aperture;

locating a second gating electrode proximate a second side of the aperture;

locating a third gating electrode where the propellant stream is located between the second and third gating electrodes;

connecting a first voltage source having a first phase to both the first gating electrode and a first electrode of the travelling wave grid;

connecting a second voltage source having a second phase lagging the first phase to both the second gating electrode and a second electrode of the travelling wave grid; and connecting a third voltage source having a third phase lagging the second phase to both the third gating electrode and a third electrode of the travelling wave grid.

24. The method of metering toner through an aperture into a propellant stream of claim 23 further comprising the step of connecting a fourth voltage source having a fourth phase lagging the third phase by approximately 90 degrees to a fourth travelling wave electrode.

* * * * *